US009375835B1

(12) United States Patent
Lin

(10) Patent No.: US 9,375,835 B1
(45) Date of Patent: Jun. 28, 2016

(54) TOOL BOX ASSEMBLY

(71) Applicant: Fairness Technology Corp., Taichung (TW)

(72) Inventor: Yi-Hung Lin, Taichung (TW)

(73) Assignee: FAIRNESS TECHNOLOGY CORP., Taichung (TW)

( * ) Notice: Subject to any disclaimer, the term of this patent is extended or adjusted under 35 U.S.C. 154(b) by 0 days.

(21) Appl. No.: 14/812,834

(22) Filed: Jul. 29, 2015

(51) Int. Cl.
*B25H 3/00* (2006.01)
*B25H 3/02* (2006.01)

(52) U.S. Cl.
CPC . *B25H 3/023* (2013.01); *B25H 3/00* (2013.01)

(58) Field of Classification Search
CPC ..... B25H 3/00; B25H 3/003; B25H 3/006; B25H 3/002; B25H 3/021; B25H 3/023; B25H 3/025
USPC ..... 220/694, 751, 521; 206/349, 372, 373, 206/503, 504, 508, 509, 511
See application file for complete search history.

(56) References Cited

U.S. PATENT DOCUMENTS

2006/0196793 A1* 9/2006 Pendergraph ..... B25H 3/003 206/372
2011/0073516 A1* 3/2011 Zelinskiy ..... B25H 3/02 206/509

* cited by examiner

*Primary Examiner* — Steven A. Reynolds
*Assistant Examiner* — Javier A Pagan

(57) ABSTRACT

A tool box assembly contains plural tool boxes with a same size or different sizes, and each tool box has a first casing and a second casing. The first casing includes at least one groove defined on a top thereof, and the first casing also includes at least one engaging portion arranged on a peripheral side of the at least one groove. The second casing covers with the first casing and includes at least one protrusion mounted on a bottom thereof and corresponding to the at least one groove of the first casing. In addition, each of the at least one protrusion has a joining portion arranged on a peripheral wall thereof and corresponding to each of the at least one engaging portion of the first casing. Thereby, the plural tool boxes with the same size or the different sizes are stacked and fixed together easily and securely.

4 Claims, 12 Drawing Sheets

TOOL BOX ASSEMBLY

FIELD OF THE INVENTION

The present invention relates to a tool box assembly in which plural tool boxes with a same size or different sizes are stacked and fixed together easily and securely.

BACKGROUND OF THE INVENTION

Conventional tool boxes are adapted to accommodate tools of various sizes and types. For example, a first tool box is employed to accommodate first tool(s) in a first size and type, and a second tool box is applicable for second tool(s) in a second size and type. In other words, a use has to carry a variety of tool boxes for accommodating tools of different sizes and types, thus casing using inconvenience.

The present invention has arisen to mitigate and/or obviate the afore-described disadvantages.

SUMMARY OF THE INVENTION

The primary objective of the present invention is to provide a tool box assembly in which plural tool boxes with a same size or different sizes are stacked and fixed together easily and securely.

To achieve above-mentioned objective, a tool box assembly provided by the present invention contains plural tool boxes with a same size or different sizes, and each tool box has a first casing and a second casing.

The first casing includes at least one groove defined on a top thereof, and the first casing also includes at least one engaging portion arranged on a peripheral side of the at least one groove.

The second casing covers with the first casing and includes at least one protrusion mounted on a bottom thereof and corresponding to the at least one groove of the first casing. In addition, each of the at least one protrusion has a joining portion arranged on a peripheral wall thereof and corresponding to each of the at least one engaging portion of the first casing.

DETAILED DESCRIPTION OF THE PREFERRED EMBODIMENTS

Figure 1:
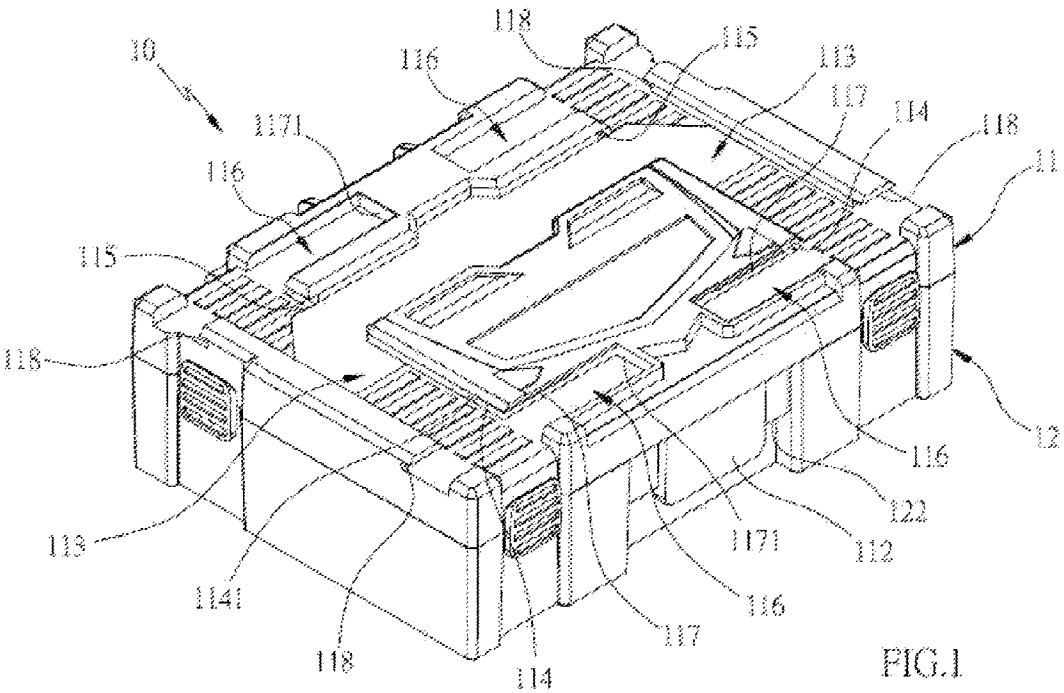
FIG. 1 is a perspective view showing the assembly of a tool box assembly according to a preferred embodiment of the present invention.
Figure 2:
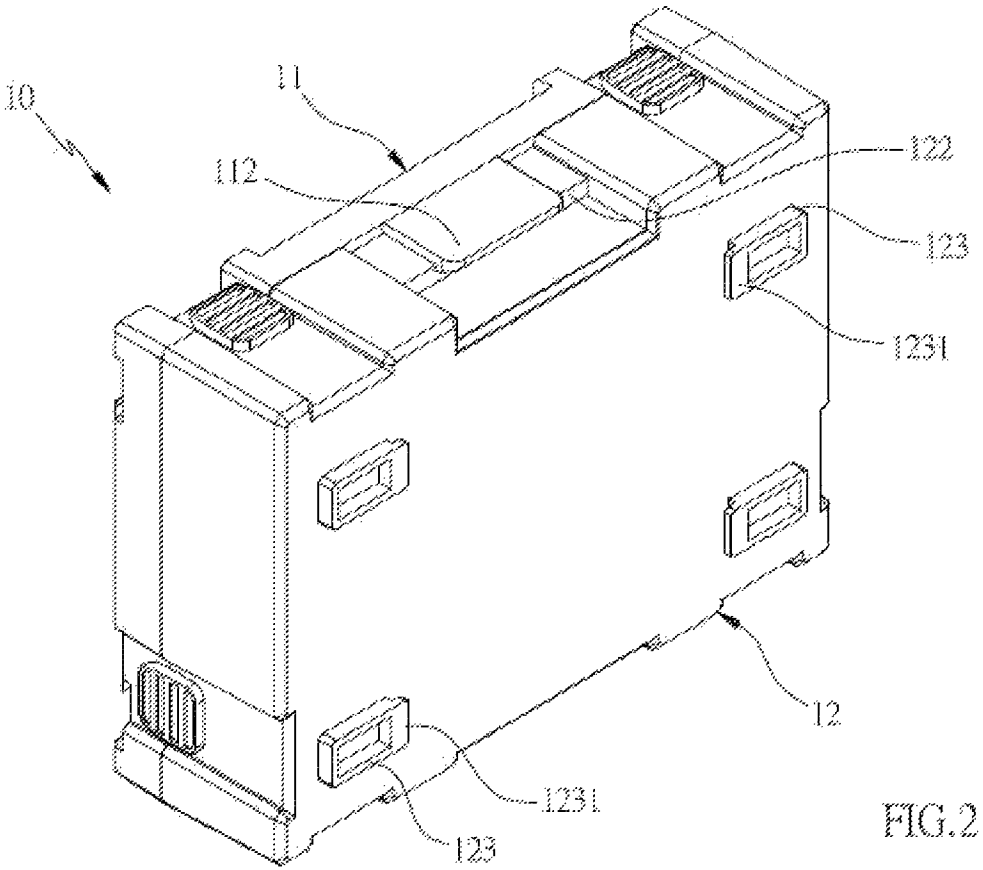
FIG. 2 is another perspective view showing the assembly of the tool box assembly according to the preferred embodiment of the present invention.

With reference to FIGS. 1-4, a tool box assembly according to a preferred embodiment of the present invention is comprised of plural tool boxes with a same size or different sizes, wherein a first tool box 10 comprises: a first casing 11 and a second casing 12 covering with the first casing 11 to define an accommodation space between the first casing 11 and the second casing 12 to accommodate at least one tool. In this embodiment, between the first casing 11 and the second casing 12 is also defined a rotatable connection structure to rotatably cover the first casing 11 and the second casing 12 together or to uncover the first casing 11 from the second casing 12, wherein the rotatable connection structure includes a first rotatable connecting portion 111 arranged on a rear end of the first casing 11, a second rotatable connecting portion 121 arranged on a rear end of the second casing 12, and a coupling shaft 13 inserted through the first rotatable connecting portion 111 of the first casing 11 and the second rotatable connecting portion 121 of the second casing 12, such that the first casing 11 and the second casing 12 cover together or uncover from each other along the coupling shaft 13. Furthermore, between the first casing 11 and the second casing 22 is further defined a locking structure to fix the first casing 11 and the second casing 12 together, wherein the locking structure includes a retainer 112 disposed on a front end of the first casing 11 and includes a fastening extension 122 formed on a front end of the second casing 12, such that when the first casing 11 and the second casing 12 cover together, the retainer 112 of the first casing 11 retains with the fastening extension 122 of the second casing 12, thus fixing the first casing 11 and the second casing 12 together. The first casing 11 includes at least one groove defined on a top thereof and includes at least one engaging portion arranged on a peripheral side of the at least one groove. The second casing 12 includes at least one protrusion mounted on a bottom thereof and corresponding to the at least one groove of the first casing 11, and each of the at least one protrusion has a joining portion arranged on a peripheral wall thereof and corresponding to each of the at least one engaging portion of the first casing 11. In this embodiment, the first casing 11 includes two first grooves 113 defined on two sides of the top thereof and includes two first engaging portions 114 arranged on the top thereof adjacent to two front ends of the two first grooves 113, wherein each of the two first engaging portions 114 has a stopping face 1141, the first casing 11 also includes two second engaging portions 115 arranged on the top thereof proximate to two rear ends of the two first grooves 113, four second grooves 116 formed on the top thereof adjacent to a front end and a rear end of the top of the first casing 11, and four third engaging portions 117 formed on four peripheral walls of the four second grooves 116, wherein each of the four third engaging portions 117 has a stop fringe 1171 defined thereon. The first casing 11 further includes four fourth engaging portions 118, two of which are defined between the two first engaging portions 114 and the front end of the first casing 11, and the other of the four fourth engaging portions 118 are defined between the two second engaging portions 115 and the rear end of the first casing 11. The second casing 12 includes four protrusions 123 mounted on the bottom thereof, wherein two of the four protrusions 123 proximate to a front end of the second casing 12 correspond to the two first engaging portions 114 of the first casing 11, and the other of the four protrusions 123 adjacent to a rear end of the second casing 12 correspond to the two second engaging portions 115 of the first casing 11, wherein each of the four protrusions 123 has a joining portion 1231 extending outwardly from one side wall thereof.

Figure 5:
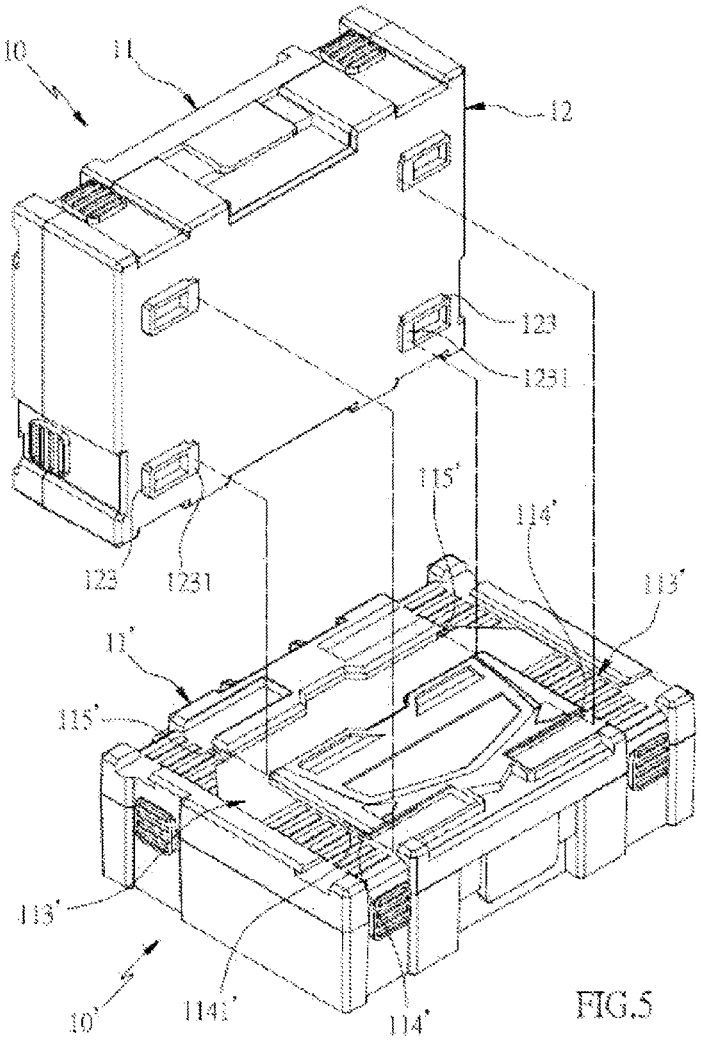
FIG. 5 is a perspective view showing the operation of the tool box assembly according to the preferred embodiment of the present invention.
Figure 6:
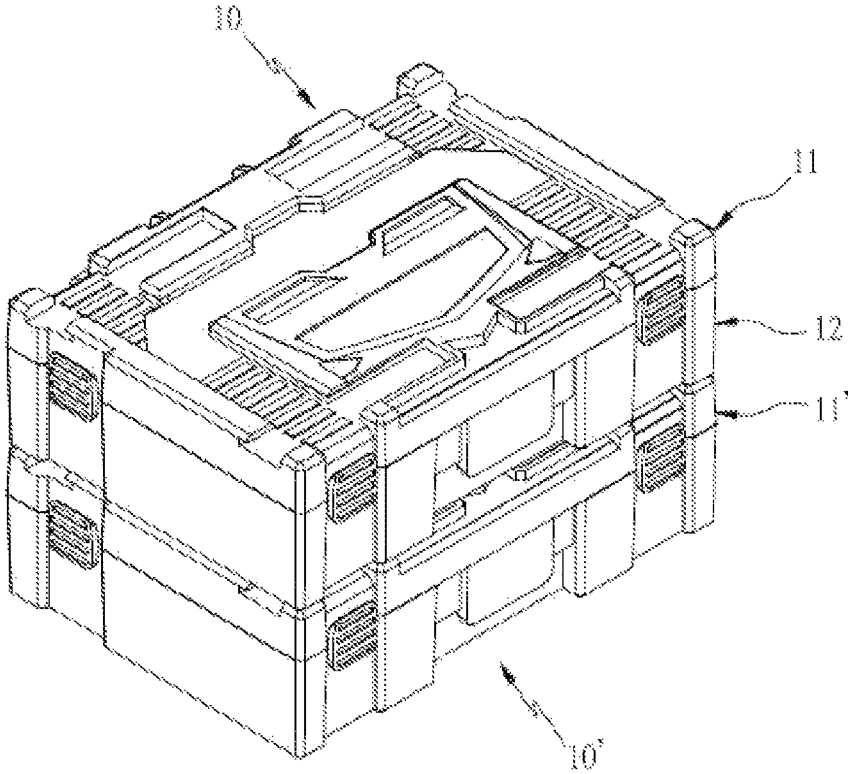
FIG. 6 is another perspective view showing the operation of the tool box assembly according to the preferred embodiment of the present invention.

Referring to FIGS. 5 and 6, a first tool box 10 and a second tool box 10' are stacked together, wherein each protrusion 123 of the second casing 12 of the first tool box 10 is placed into each first groove 113' of a first casing 11' of the second tool box 10', and the first tool box 10 or the second tool box 10' is pushed so that each joining portion 1231 of the second casing 12 of the first tool box 10 is retained into each first engaging portion 114' or each second engaging portion 115' of the first casing 11' of the second tool box 10', and the stopping face 1141' of each first engaging portion 114' of the first casing 11' of the second tool box 10' stops each joining portion 1231 of the second casing 12 of the first tool box 10, thus securely stacking and fixing the first tool box 10 and the second tool box 10' together.

Figure 3:
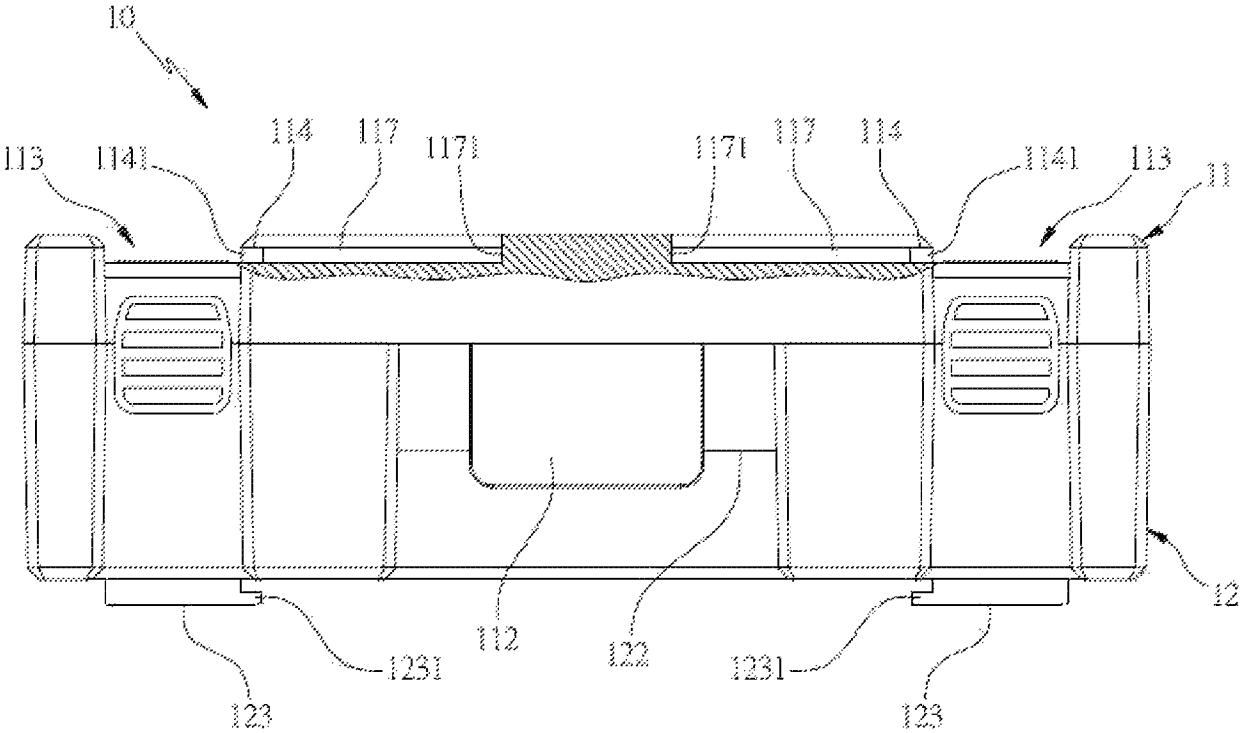
FIG. 3 is a side plane view showing the assembly of the tool box assembly according to the preferred embodiment of the present invention.
Figure 4:
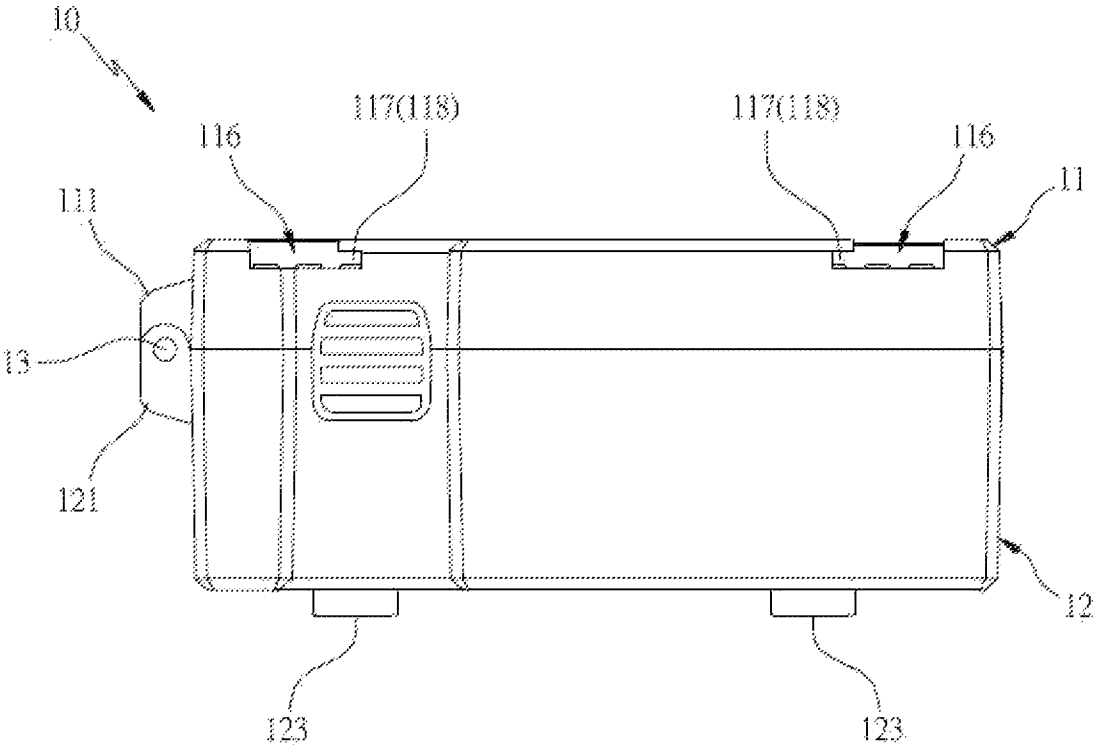
FIG. 4 is another side plane view showing the assembly of the tool box assembly according to the preferred embodiment of the present invention.
Figure 7:
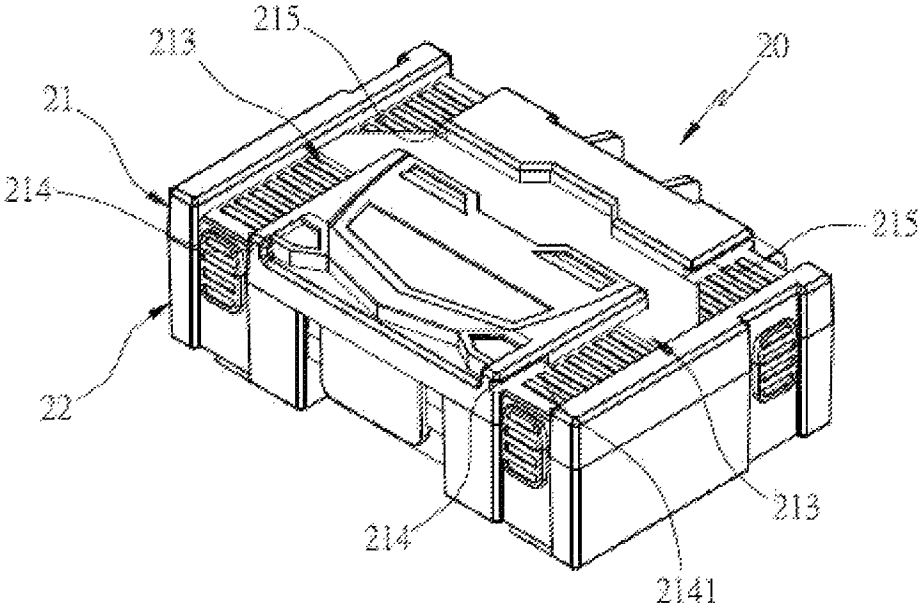
FIG. 7 is a perspective view showing the assembly of a second tool box of the tool box assembly according to the preferred embodiment of the present invention.
Figure 8:
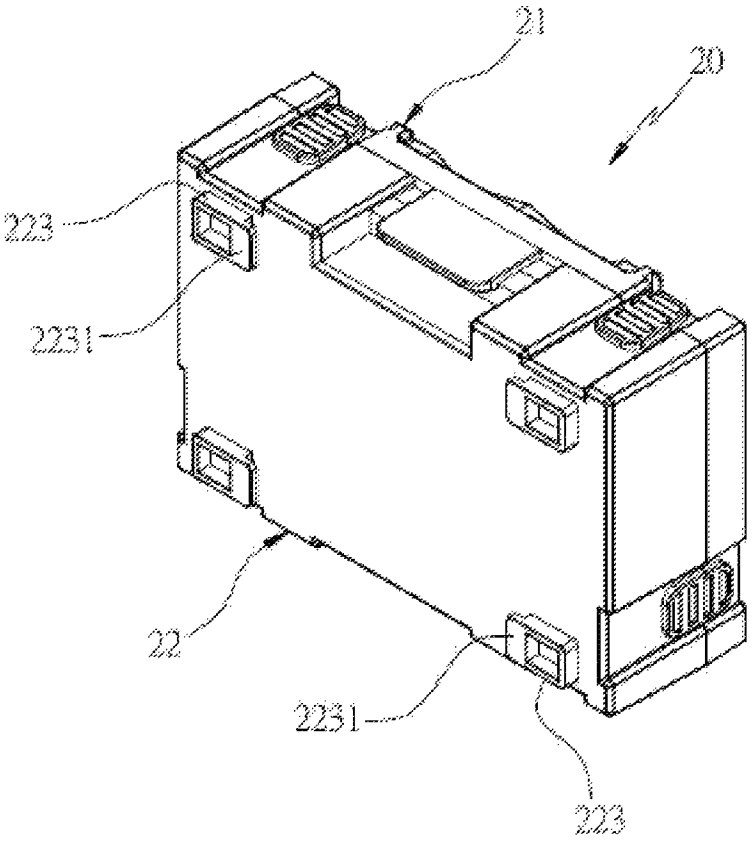
FIG. 8 is another perspective view showing the assembly of the second tool box of the tool box assembly according to the preferred embodiment of the present invention.

As shown in FIGS. 3, 7 and 8, the first tool box 10 is connected with at least one third tool box 20 by ways of the four third engaging portions 117 and the four fourth engaging portions 118, wherein a size of the at least one third tool box 20 is different from that of the first tool box 10. Each of the at least one third tool box 20 comprises a first casing 21 and a second casing 22 rotatably covering with the first casing 21. In this embodiment, a length of each of two sides of the at least one third tool box 20 is equal to a length of the front end or the rear end of the first tool box 10, and a length of each of a front end and a rear end of each third tool box 20 is equal to a length of each of the two sides of the first tool box 10. The first casing 21 of each third tool box 20 has two first grooves 213 defined on a top thereof adjacent to two sides of the first casing 21. The first casing 21 of each third tool box 20 also has two first engaging portions 214 arranged on the top thereof adjacent to two front ends of the two first grooves 213, wherein each of the two first engaging portions 214 has a stopping face 2141. The first casing 21 further has two second engaging portions 215 arranged on the top thereof proximate to two rear ends of the two first grooves 213. Preferably, the two first grooves 213 of the first casing 21 of each third tool box 20 correspond to the four second grooves 116 of the first tool box 10, the two first engaging portions 214 of the first casing 21 of each third tool box 20 correspond to the four third engaging portions 117 of the first tool box 10, and the two second engaging portions 215 of the first casing 21 of each third tool box 20 correspond to the four fourth engaging portions 118 of the first tool box 10. The second casing 22 of each third tool box 20 has four protrusions 223 mounted on a bottom thereof, wherein two of the four protrusions 223 proximate to a front end of the second casing 22 correspond to the two first engaging portions 214 of the first casing 21, and the other of the four protrusions 223 adjacent to a rear end of the second casing 22 correspond to the two second engaging portions 215 of the first casing 21, wherein each of the four protrusions 223 has a joining portion 2231 extending outwardly from one side wall thereof.

Figure 9:
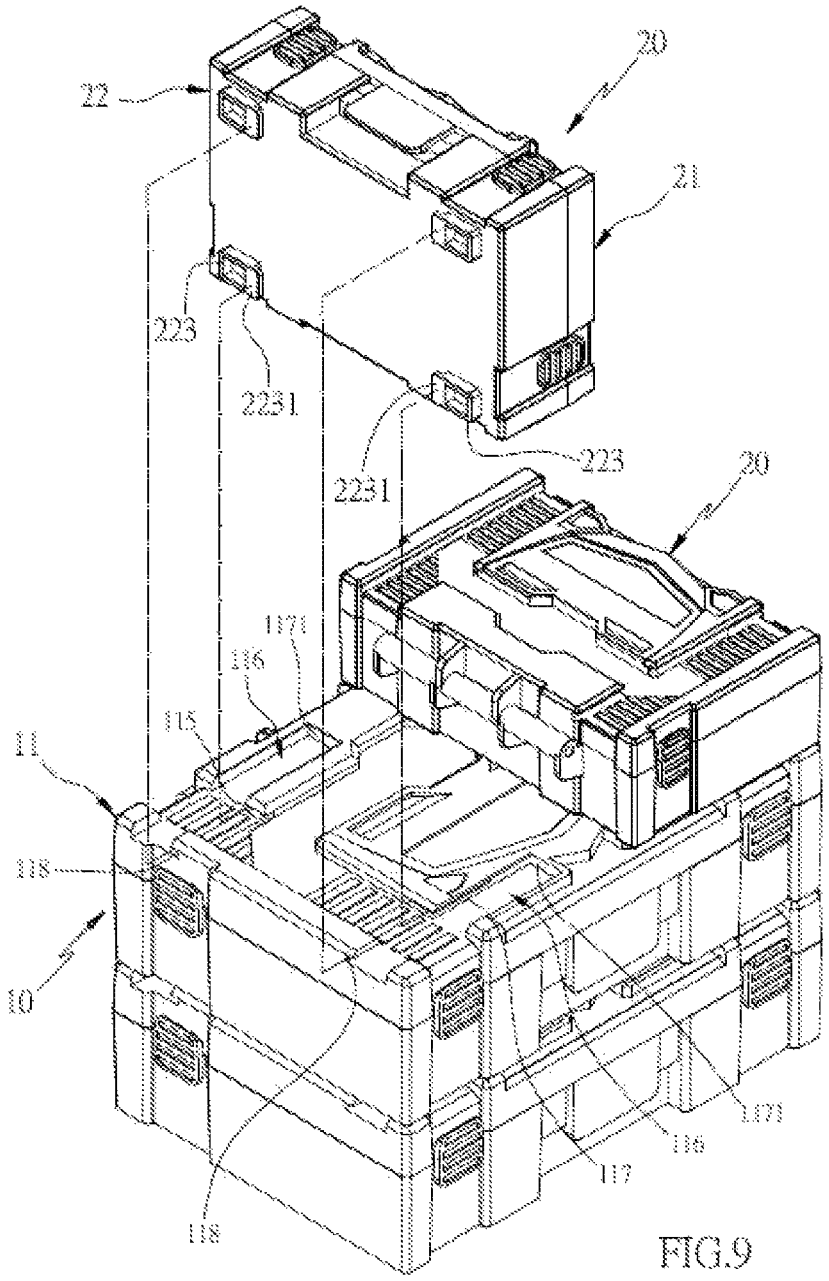
FIG. 9 is also another perspective view showing the operation of the tool box assembly according to the preferred embodiment of the present invention.
Figure 10:
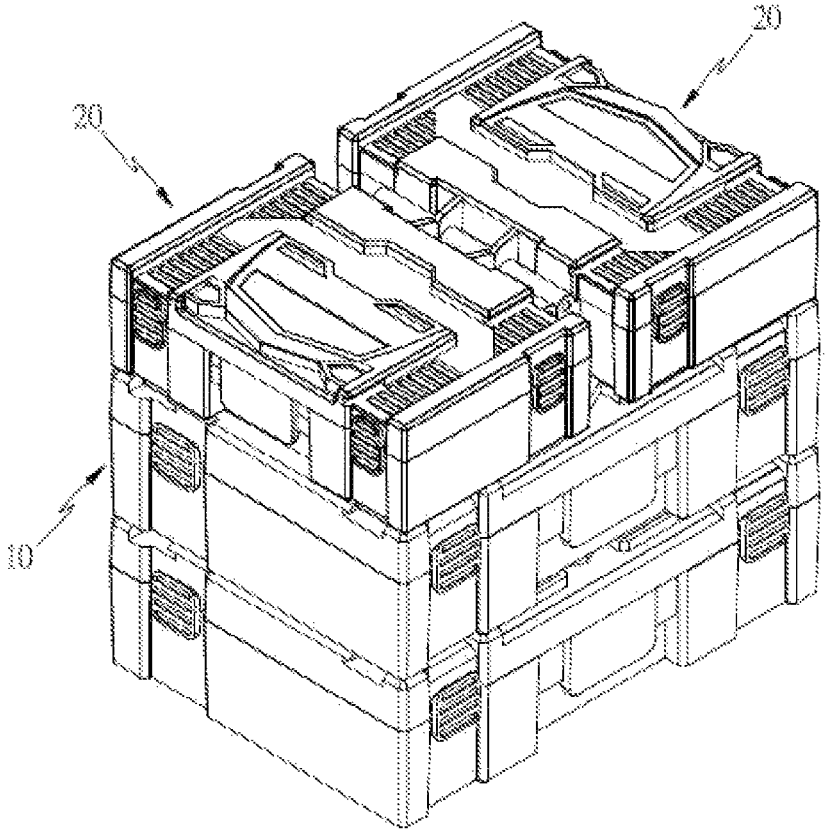
FIG. 10 is still another perspective view showing the operation of the tool box assembly according to the preferred embodiment of the present invention.

With reference to FIGS. 9 and 10, at least one first tool box 10 and the at least one third tool box 20 are stacked together, wherein each protrusion 223 of the second casing 22 of each third tool box 20 is placed into each second groove 116 of an uppermost one of the at least one first tool box 10, and each third tool box 20 or the uppermost first tool box 10 is pushed so that each joining portion 2231 of the second casing 22 of each third tool box 20 is retained into each third engaging portion 117 or each fourth engaging portion 118 of the first casing 11 of the uppermost first tool box 10, and the stop fringe 1171 of each third engaging portion 117 of the first casing 11 of the uppermost first tool box 10 stops each joining portion 2231 of the second casing 22 of each third tool box 20, thus securely stacking and fixing the at least one first tool box 10 and the at least one third tool box 20 together.

Figure 11:
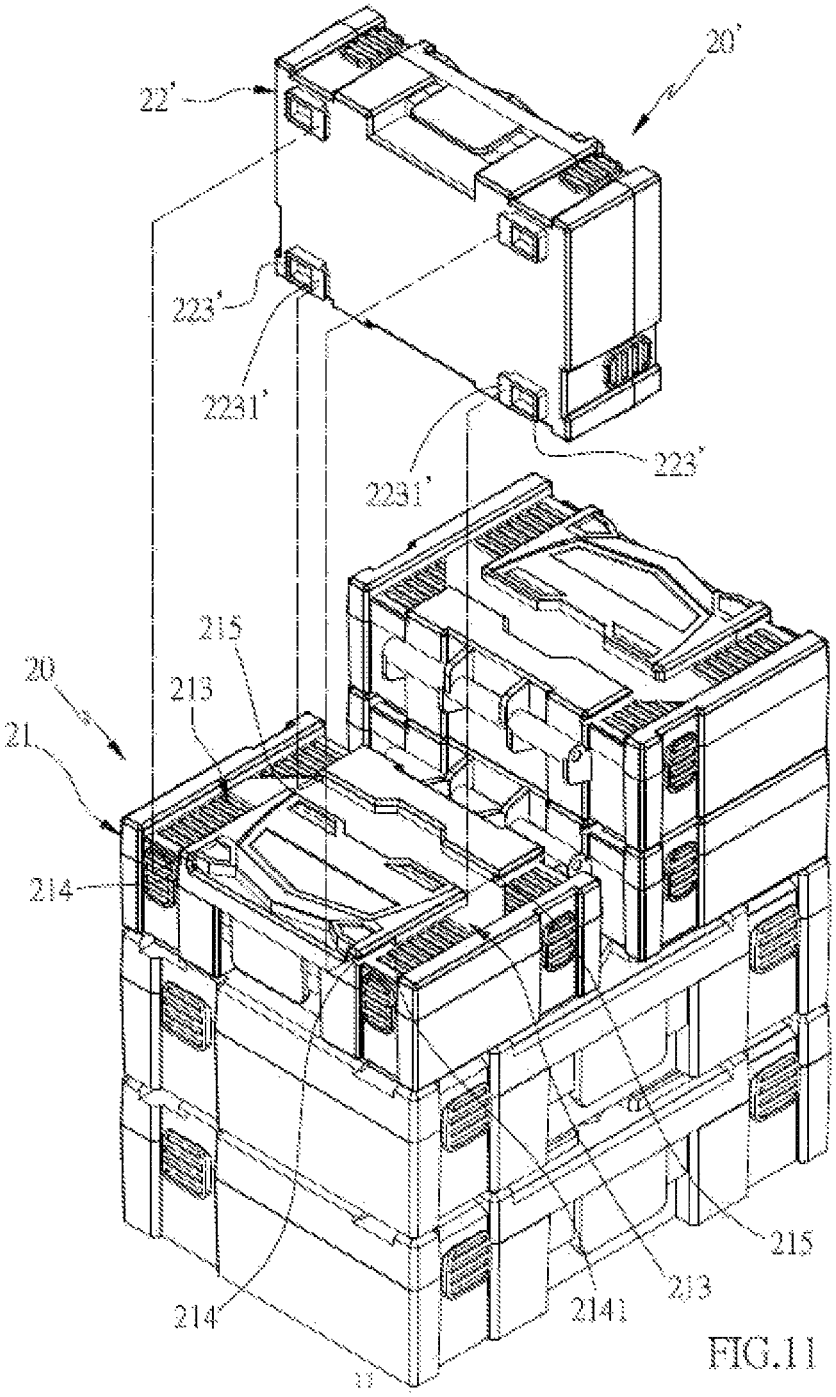
FIG. 11 is another perspective view showing the operation of the tool box assembly according to the preferred embodiment of the present invention.
Figure 12:
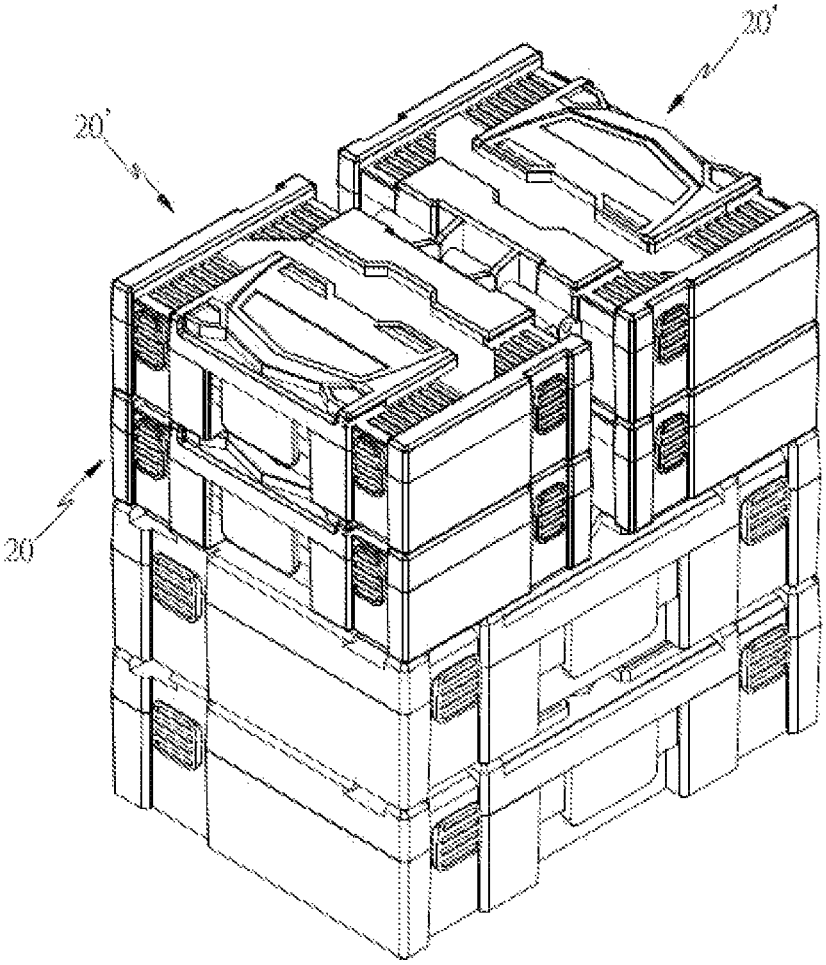
FIG. 12 is still another perspective view showing the operation of the tool box assembly according to the preferred embodiment of the present invention.

Referring to FIGS. 11 and 12, as stacking at least one fourth tool box 20' on the at least third tool box 20, wherein each protrusion 223' of a second casing 22' of the at least one fourth tool box 20' is placed into each of the two first grooves 213 of the at least third tool box 20, and each fourth tool box 20' is pushed so that each joining portion 2231' of the second casing 22' of each fourth tool box 20' is retained into each first engaging portion 214 or each second engaging portion 215 of the first casing 21 of the at least one third tool box 20, and the stopping face 2141 of each first engaging portion 214 of the first casing 21 of the at least one third tool box 20 stops each joining portion 2231' of the second casing 22' of each fourth tool box 20', thus securely stacking and fixing the at least one third tool box 20 and the at least one fourth tool box 20' together.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A tool box assembly being comprised of plural tool boxes with a same size or different sizes, wherein each tool box comprises:

a first casing including at least one groove defined on a top thereof, and the first casing also including at least one engaging portion arranged on a peripheral side of the at least one groove;

a second casing covering with the first casing and including at least one protrusion mounted on a bottom thereof and corresponding to the at least one groove of the first casing, and each of the at least one protrusion having a joining portion arranged on a peripheral wall thereof and corresponding to each of the at least one engaging portion of the first casing;

wherein the first casing includes two first grooves defined on two sides of the top thereof and includes two first engaging portions arranged on the top thereof adjacent to two front ends of the two first grooves, wherein each of the two first engaging portions has a stopping face, and the first casing also includes two second engaging portions arranged on the top thereof proximate to two rear ends of the two first grooves;

wherein the second casing includes four protrusions mounted on the bottom thereof, wherein two of the four protrusions proximate to a front end of the second casing correspond to the two first engaging portions of the first casing, and the other of the four protrusions adjacent to a rear end of the second casing correspond to the two second engaging portions of the first casing, wherein each of the four protrusions has a joining portion extending outwardly from one side wall thereof;

wherein the first casing further includes four second grooves formed on the top thereof adjacent to a front end and a rear end of the top of the first casing, and four third engaging portions formed on four peripheral walls of the four second grooves, wherein each of the four third engaging portions has a stop fringe defined thereon; the first casing further includes four fourth engaging portions, two of which are defined between the two first engaging portions and the front end of the first casing, and the other of the four fourth engaging portions are defined between the two second engaging portions and the rear end of the first casing.

2. The tool box assembly as claimed in claim 1, wherein between the first casing and the second casing is defined an accommodation space to accommodate at least one tool.

3. The tool box assembly as claimed in claim 1, wherein between the first casing and the second casing is also defined a rotatable connection structure to rotatably cover the first casing and the second casing together or to uncover the first casing from the second casing, wherein the rotatable connection structure includes a first rotatable connecting portion arranged on a rear end of the first casing, a second rotatable connecting portion arranged on a rear end of the second casing, and a coupling shaft inserted through the first rotatable connecting portion of the first casing and the second rotatable connecting portion of the second casing.

4. The tool box assembly as claimed in claim 1, wherein between the first casing and the second casing is further defined a locking structure to fix the first casing and the second casing together, and the locking structure includes a retainer disposed on a front end of the first casing and includes a fastening extension formed on a front end of the second casing.

* * * * *